US005709136A

United States Patent [19]

Frenkel

[11] Patent Number: 5,709,136

[45] Date of Patent: Jan. 20, 1998

[54] POWER DRIVEN TOOLS

[75] Inventor: Eli C. Frenkel, Long Beach, Calif.

[73] Assignee: McDonnell Douglas Corporation, Long Beach, Calif.

[21] Appl. No.: 621,345

[22] Filed: Feb. 25, 1996

[51] Int. Cl.[6] ..... B25B 21/00

[52] U.S. Cl. ..... 81/57.13; 81/57.29

[58] Field of Search ..... 81/57.3, 57.29, 81/57.13, 57.11, 57.14, 57.31, 57.42, 57.45, 57.46

[56] References Cited

U.S. PATENT DOCUMENTS

| | | | |
|---|---|---|---|
| 1,384,811 | 7/1921 | Strand . | |
| 1,526,502 | 2/1925 | Pilger, Jr. . | |
| 2,654,407 | 10/1953 | Dremel . | |
| 2,672,065 | 4/1954 | Danuskie . | |
| 2,808,749 | 10/1957 | Lampke . | |
| 2,817,256 | 12/1957 | Malone et al. . | |
| 2,938,415 | 5/1960 | Kostka | 81/57.29 X |
| 2,973,676 | 3/1961 | Nelson . | |
| 3,267,776 | 8/1966 | Watson | 81/57.29 |
| 3,430,510 | 3/1969 | Hendrickson | 81/57.29 X |
| 3,620,105 | 11/1971 | Batten | 81/57.14 |
| 3,707,893 | 1/1973 | Hofman | 81/57.29 X |
| 4,240,310 | 12/1980 | Roth . | |
| 4,311,072 | 1/1982 | Hudgins | 81/57.29 X |
| 4,362,072 | 12/1982 | Tillman . | |
| 4,491,042 | 1/1985 | Lopochonsky . | |
| 4,528,873 | 7/1985 | Lee . | |
| 4,735,118 | 4/1988 | Broemel, Jr. . | |
| 4,800,785 | 1/1989 | Christensen | 81/57.29 |
| 4,827,809 | 5/1989 | Broemel, Jr. . | |
| 4,907,476 | 3/1990 | Singleton | 81/57.29 |
| 5,072,633 | 12/1991 | Smith . | |

FOREIGN PATENT DOCUMENTS

| | | | |
|---|---|---|---|
| 500185 | 11/1954 | Italy | 81/57.29 |

*Primary Examiner*—D. S. Meislin

*Attorney, Agent, or Firm*—The Bell Seltzer Intellectual Property Law Group of Alston & Bird LLP

[57] ABSTRACT

According to one embodiment, a power driven socket wrench is disclosed to rotate nuts and bolts in confined spaces including a head formed of a rotatable socket for engaging nuts and bolts, a bearing for the rotatable socket and a housing around the socket and bearing. The socket has a plurality of gear teeth thereon extending around its axis. An important feature of the invention is the provision of a drive adapter between the head and a power drive for driving the socket. The adapter is detachable from the head and the power drive for replacement by an adapter of a different length to enable reaching a nut or bolt at a more remote distance. The adapter has an outer elongate housing containing an elongate drive shaft mounted axially therein on suitable bearings. The adapter housing and shaft are positioned for rotation of the shaft on an axis extending perpendicular to the rotational axis of the socket on the head. A rotatable input gear is mounted on the inner end of the shaft and meshes with the gear teeth around the socket for driving same. The adapter has a detachable locking means such as a snap lock at its inner end for detachably locking the adapter onto the housing of the head. The outer end of the adapter drive shaft has a detachable locking member for detachably engaging the driver member of a power drive or motor.

11 Claims, 3 Drawing Sheets

10
12
14
16
18
20
22
24
26
28
30
32
34
36
38
40
42
44
46
48
50
52
Q
6

POWER DRIVEN TOOLS

BACKGROUND OF THE INVENTION

1. Field of the Invention

The present invention relates to power driven tools such as socket wrenches, and is particularly directed to socket wrenches and other tool applications of this type designed to enable rotation of a fastener engaging head in confined spaces.

2. Brief Description of Related Art

Various types of wrenches are known in the art to provide for quick tightening and loosening of a nut or bolt, such as ratchet wrenches and box wrenches. However, these wrenches are difficult to use in confined spaces, particularly where limited space is available for wrench handle movement.

Improvements have been made over the conventional ratchet and box wrenches for quick tightening and loosening of a nut or bolt in confined spaces and under conditions of highly limited wrench handle movement. Thus, for example, U.S. Pat. No. 2,240,310 and U.S. Pat. No. 4,362,072 are directed to power wrenches which are operable by rotation of a drive shaft for rotating a socket member engagable with a nut or bolt, on an axis perpendicular to the axis of the drive shaft. However, the structures of these devices are relatively complex. Further, such devices lack versatility to enable reaching nuts and bolts in confined spaces at varying depths or distances.

OBJECTS OF THE INVENTION

It is accordingly one object of the invention to provide a versatile means in the form of a drive adapter which can be applied to various types of tools, such as wrenches, for rotation thereof in confined spaces.

Another object of the invention is to provide a novel and improved socket wrench for use in confined spaces which cannot he reached by conventional wrenches, and incorporating such drive adapter.

Another object is the provision of a wrench of the above type in which the head of the wrench includes a rotatable socket member driven by a rotating shaft, the socket being replaceable to accommodate nuts and bolts of different sizes.

A still further and particular object is to provide a socket wrench of the above type including replaceable drive adapters to accommodate drive shafts of different lengths for increasing the versatility of the wrench to reach nuts and bolts in remote zones of varying distances of proximity.

Other objects and advantages of the invention will be apparent from the following description of the invention.

SUMMARY OF THE INVENTION

According to a preferred embodiment of the invention, a power wrench is provided which consists essentially of a head formed of a rotatable socket member for engaging nuts and bolts, a bearing member for the rotatable socket member and a housing member around the socket and bearing members, a detachable drive adapter or extension, and a power drive. The drive adapter contains an elongated drive shaft having a gear at one end for meshing with a gear on the socket member, detachable locking means between the drive adapter and the head housing member, and detachable connecting means at the other end of the drive shaft for removable engagement with a drive member of the power drive, such as a compressed air motor.

The socket wrench of the invention is a versatile and durable wrench designed to be used in confined spaces not reachable or practical for conventional wrenches. The head of the rotatable socket member is essentially flat and has a polygonal central opening for engaging a nut or bolt of a particular size and shape. The socket member is replaceable to accommodate nuts and bolts of different sizes and shapes, such as ⅜" and ½" square heads. The socket member has a plurality of gear teeth thereon extending around its axis. The bearing member extends circumferentially around the socket member and rotatably supports the socket member on an axis at the center of the opening. The housing is provided around the socket member and bearing member of the head.

An important feature of the invention is the provision of a drive adapter between the head and a power drive for driving the socket member. The adapter is detachable from the head and the power drive for replacement by an adapter of a different length, to enable reaching a nut or bolt at a more remote distance. The adapter has an outer elongated housing containing an elongated drive shaft mounted axially therein on suitable bearings. The adapter housing and shaft are positioned for rotation of the shaft on an axis extending perpendicular to the rotational axis of the socket member on the head. A rotatable input gear is mounted on the inner end of the shaft and meshes with the gear teeth around the socket member for driving same. The adapter has a detachable locking means such as a snap lock at its inner end for detachably locking the adapter onto the housing for the head. The outer end of the adapter drive shaft has a detachable locking member for detachably engaging the drive member of a power drive or motor, such as a compressed air motor, for imparting the power drive to the shaft and input gear for rotating the socket member. The adapter functions as a handle for the wrench.

The socket wrench of the invention has the capacity to support from small to large fasteners in areas where conventional types of wrenches cannot be used, and the ability to employ easily changeable or replaceable adapters of different lengths permits the user the versatility required to reach fasteners in locations at different remote distances in hard-to-reach mechanical assemblies.

The air motor driver unit can be used directly with various adapters for greater versatility. Also, a manual driver assembly can be used, for example, where an air compressor for operating a compressed air motor is not available.

In addition to application of the versatile drive adapter concept of the invention to a nut and bolt socket wrench, such concept can be employed in other applications, such as bolt extractors, drills, sanders, screw drivers, hole saw cutters, grinders, etc. To achieve the various torque ranges required in the different applications, various drive motor sizes will be required based on the particular application.

BRIEF DESCRIPTION OF THE DRAWINGS

Figures 1, 2, 3:
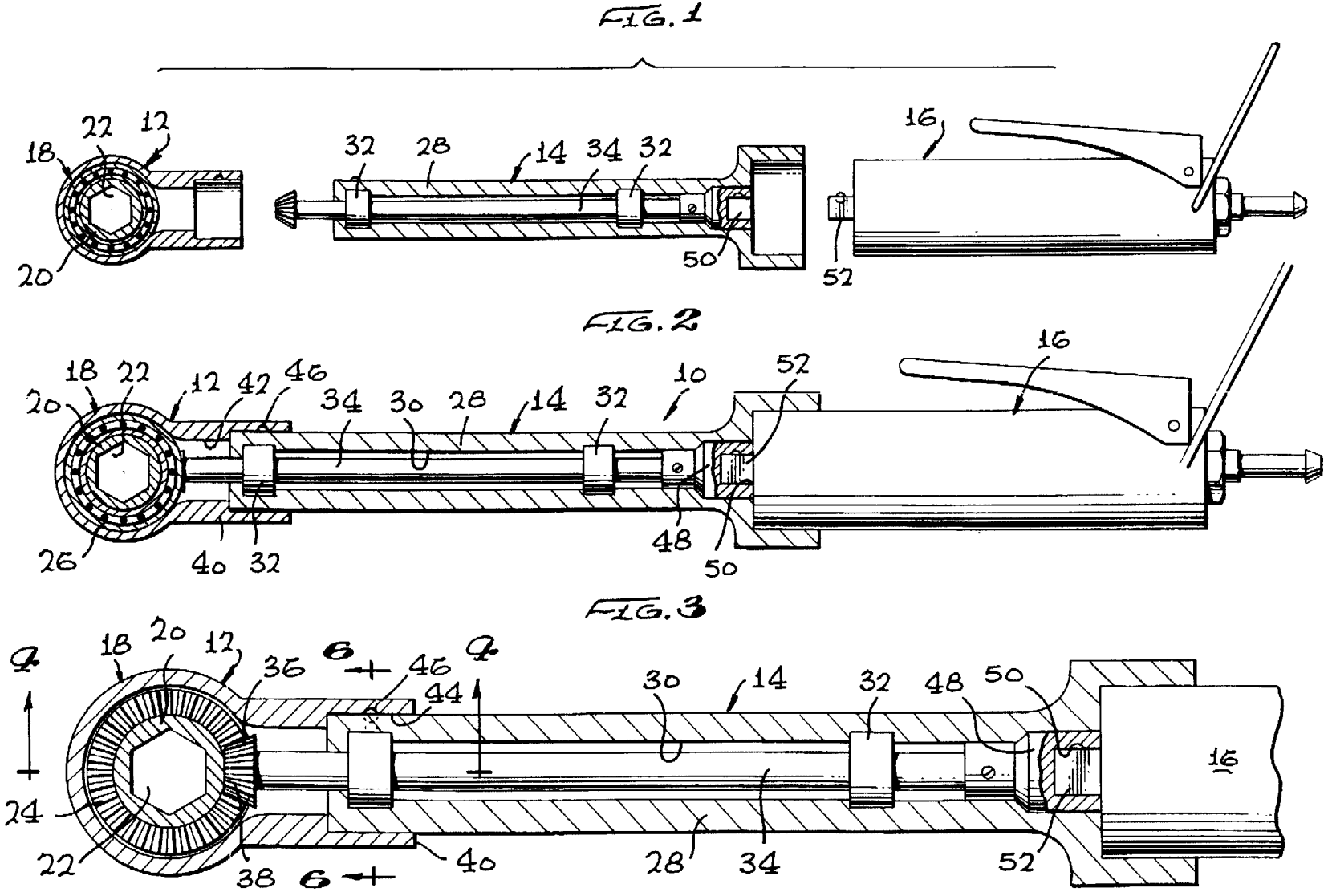
Figure 4:
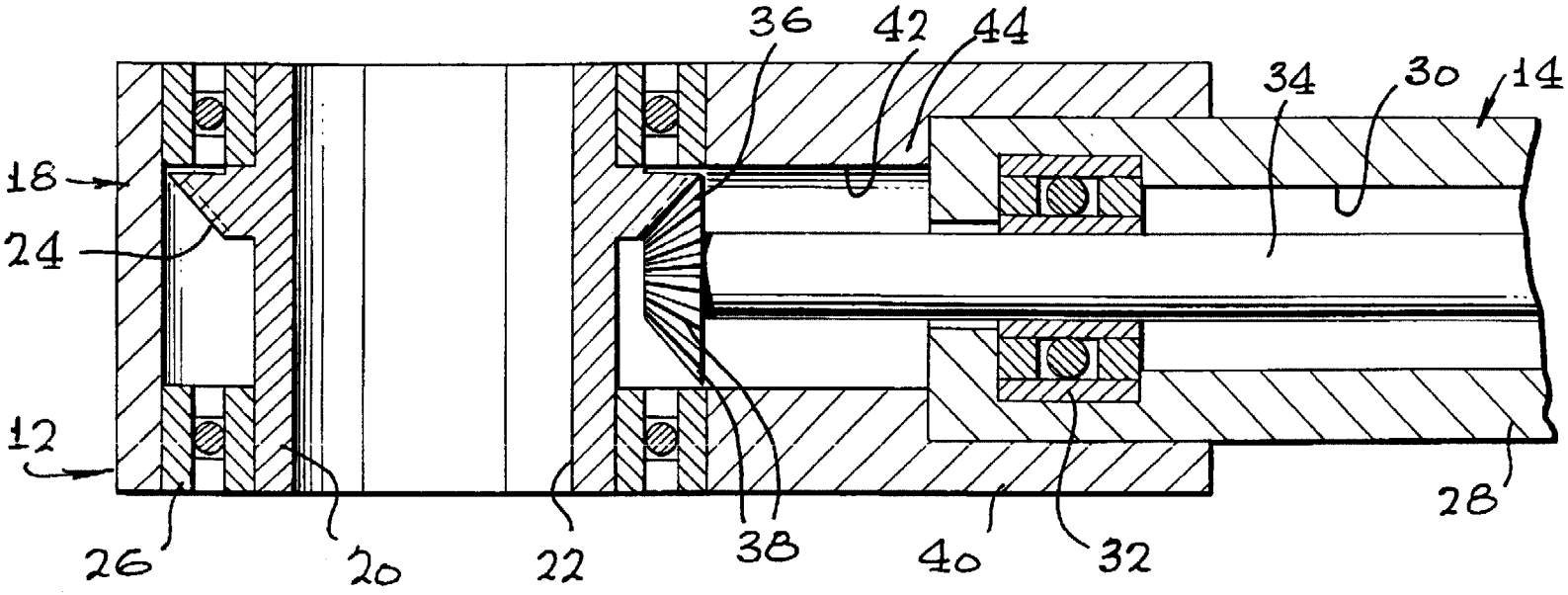
Figure 5:
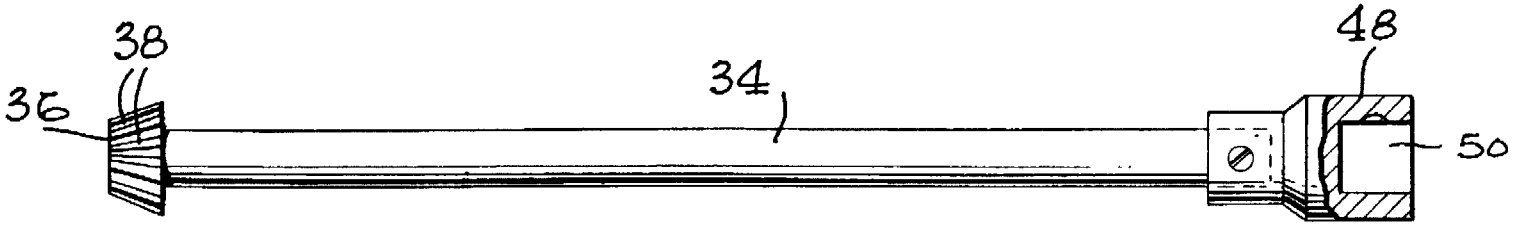
Figure 9:
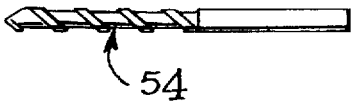
Figure 6:
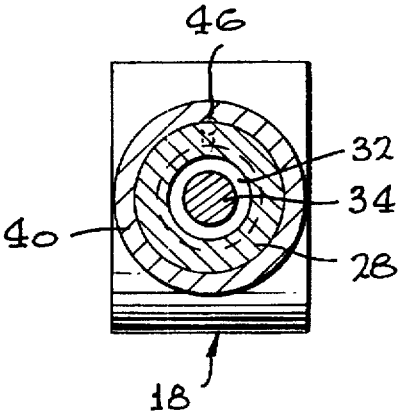
Figure 7:
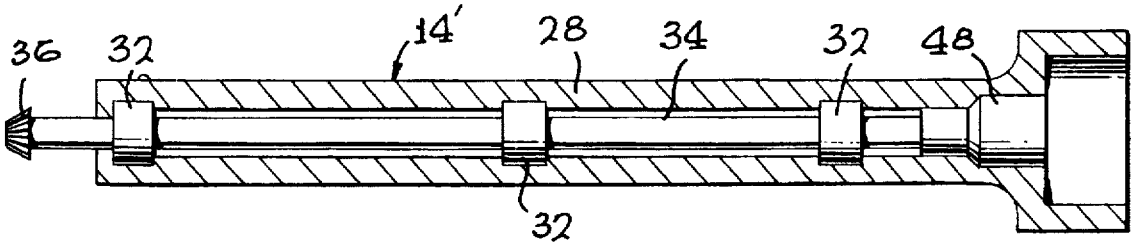
Figure 8:
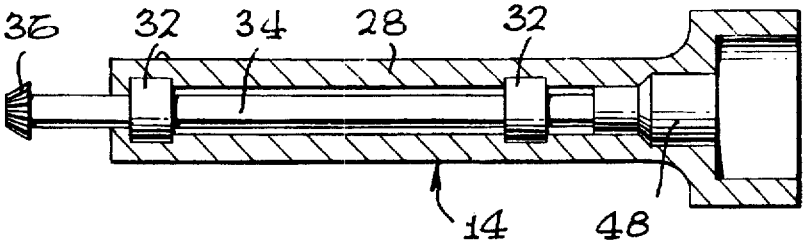

Having thus described the invention in general terms, reference will now be made to the accompanying drawings in which:

FIG. 1 is an exploded elevational view, mainly in section, of a preferred embodiment of the socket wrench of the invention, showing the three separate components, namely, the head, the drive adapter and the motor drive;

FIG. 2 shows the socket wrench of FIG. 1 in assembled form;

FIG. 3 shows a longitudinal section of the drive adapter in driving relation with the socket member at one end and the drive motor at the other end;

FIG. 4 is a sectional view of the head and a portion of the drive adapter of FIG. 3, taken on line 4—4 of FIG. 3, showing the input gear in engagement with the gear teeth on the socket member;

FIG. 5 is an elevational view of the drive adapter on the socket wrench of FIG. 1, showing the elongated shaft with the drive gear at one end and a detachable locking member at its opposite end;

FIG. 6 is a section on line 6—6 of FIG. 3;

FIGS. 7 and 8 illustrate replaceable drive adapters having the structure of FIGS. 2 and 3, but of different sizes or lengths which can be employed with the head and motor drive components of FIG. 1; and FIGS. 9–12 illustrate other types of tools to which the drive adapter concept can be applied.

DETAILED DESCRIPTION OF A PREFERRED EMBODIMENT

Referring in more detail and by reference characters to the drawings, with particular reference to FIGS. 1 and 2 of the drawings, the wrench of the invention, represented by numeral 10, includes a head 12, a drive adapter 14 for the handle and a rotatable power drive 16, which can be of any desired type, such as an electric motor and preferably a compressed air motor. When assembled together in the manner described more particularly below, the three components of FIG. 1 form the wrench shown in FIG. 2.

Referring also to FIGS. 3–6, illustrating the structural details of the wrench of FIG. 2, the head 12 has an outer housing 18 and secured therein is a flat circular rotatable socket member 20 having a polygonal, e.g. hexagonal central opening 22 for placement over the nut or bolt which is to be turned. The socket member can be replaced with other socket members having different central opening shapes as desired. Rotation of the power drive 16 in either direction results in the desired rotation of socket member 20, as described in detail below.

The socket member 20 has a plurality of gear teeth 24 thereon extending circularly around the socket member and around the axis thereof. A bearing member 26 extends circumferentially around and supports the socket member. The socket member 20 and bearing member 26 are separate components connected together, e.g. by heat treat expansion.

The drive adapter 14 has an outer elongated, e.g. circular, housing 28 having a central axial bore 30 therein. Mounted on bearings 32 in the bore 30 is an elongated rotatable drive shaft 34. A rotary bevelled input gear 36 is mounted on the inner end of shaft 34. The teeth 38 of gear 36 mesh with the gear teeth 24 around the socket member 20 for rotation thereof on an axis perpendicular to the axis of rotation of drive shaft 34.

The housing 18 on the head 12 curves outwardly at 40 at one end of such housing to form an opening 42. The inner end of the adapter housing 28, drive shaft 34 and the input gear 36 thereon pass through opening 42 to permit meshing engagement of input gear 36 with gear teeth 24 on the socket member. The adapter housing 28 is secured in place on the inside wall 44 of the outwardly extending portion 40 of head housing 18, by means of a detent snap lock 46. The drive adapter 14 including housing 28, drive shaft 34 and input gear 36 are removable from the head 12 by pulling outwardly on the adapter to disengage the snap lock 46.

Within the bore 30 of adapter housing 28 at the opposite end from gear 36 is mounted a female member 48 having a square shaped opening 50. This opening 50 receives the square driver 52 of compressed air motor 16 in frictional engagement for driving the elongated shaft 34 of adapter 14 for rotation of socket member 20.

Referring to FIGS. 7 and 8, there is illustrated two separate drive adapters 14 and 14' of substantially the same construction as described above, but of different lengths. Thus, for example, if a particular nut or bolt to be turned by the socket wrench of the invention, as illustrated in FIGS. 2 and 3, cannot be reached, then the drive adapter 14, with its associated components 28, 34 and 36, can be unlocked from snap lock 46, and removed by pulling female member 48 free from the square driver 52 of motor 16. The adapter 14 can then be replaced by driver adapter 14' of FIG. 8*b* by snapping in place on head 12 by means of snap lock 46, and frictionally engaging the female member 48 with the square driver 52 of air motor 16.

Figure 10:
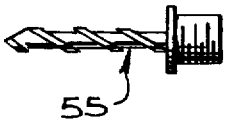
Figure 11:
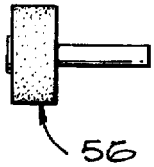
Figure 12:
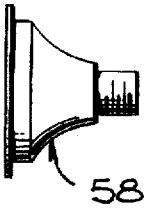

Now referring to FIGS. 9, 10, 11 and 12, FIG. 9 illustrates a drill set 54, FIG. 10 a threaded shank drill set 55, FIG. 11 a grinder 56, and FIG. 12 a sanding wheel 58, to which a drive adapter, similar to drive adapter 14, can be applied for rotation of elements 54, 55, 56 and 58 in confined spaces. However, for this purpose, the input gear 36 on the drive shaft 34 of the drive adapter would be replaced by a suitable connecting element or chuck for driving engagement with element 54, 55, 56 or 58.

From the foregoing, it is seen that the invention provides a versatile drive adapter concept for application on various types of tolls for rotation in confined spaces. A preferred embodiment is the provision of a versatile durable easy driver socket wrench particularly adapted for tightening and loosening nuts and bolts in confined areas, and formed of a minimum of structural parts. The socket wrench is designed to support or perform on small or large fasteners, and from varying remote distances with respect to the fasteners. The socket wrench of the invention is open ended and is designed to reach "oversize" fasteners and is not limited to the size of the fastener nor the size of the socket depth.

Since various changes and modifications of the invention will occur to those skilled in the art within the spirit of the invention, the invention is not to be taken as limited except by the scope of the appended claims.

Having thus described the invention, what I desire to claim and secure by letters patent is:

1. In a power driven socket wrench having;

a) a socket member with a polygonal central opening for engaging a nut or bolt head;

b) a bearing member extending circumferentially around and rotatably supporting said socket member for rotation on an axis at the center of said opening;

c) a housing member around said socket member and said bearing member;

d) said socket member having a series of gear teeth thereon extending circularly around its axis;

e) a power drive for said socket member;

f) the improvement which comprises a plurality of individual drive adapters for use in said power driven socket wrench and each of said drive adapters having a length which is different from the other drive adapters to enable the wrench to be extended into confined areas of differing depths, each drive adapter connecting said power drive and said socket member, each said drive adapter further comprising:

1) an elongate drive shaft mounted on an axis generally perpendicular to the axis of rotation of said socket member;

2) an input gear mounted on one end of said drive shaft and in meshing engagement with the gear teeth on said socket member for rotation thereof;

3) detachable connecting means between the power drive and the other end of said drive shaft; and 4) detachable locking means between said drive adapter and said housing member adjacent said one end of said drive shaft for optionally attaching and detaching said drive adapter from said housing member and said power drive such that differing sized drive adapters may be attached to said power drive increasing the versatility of the socket wrench to be extended into confined regions at a desired depth.

2. The socket wrench of claim 1, said drive adapter having an elongate housing defining a central axial bore through which said drive shaft extends, and bearing members in the central axial bore of said housing for rotatably supporting said shaft for axial rotation in said bore.

3. The socket wrench of claim 2 wherein said detachable connecting means comprises a connector member mounted on said other end of said drive shaft proximate said power drive and within said adapter housing, and a mating connector member on said power drive.

4. The socket wrench of claim 3 wherein said power drive is a compressed air motor, said connector member on said drive shaft being a female coupling member and said mating connector member being a driver member received within and frictionally engaging said female coupling member and imparting the power drive to said shaft and input gear and to said socket member.

5. The socket wrench of claim 2, said housing member having an opening on one side thereof to receive said one end of said drive shaft and said input gear therein, one end of said elongate drive adapter housing extending within said housing member to close said opening, said detachable locking means comprising a snap lock on the adjacent walls of said drive adapter housing and said housing member.

6. The socket wrench of claim 4, said housing member having an opening on one side thereof to receive said one end of said drive shaft and said input gear thereon, one end of said elongate drive adapter housing extending within said housing member to close said opening, said detachable locking means comprising a snap lock on the adjacent walls of said drive adapter housing and said housing member.

7. The socket wrench of claim 1 wherein said detachable locking means comprises a detent on a wall of said housing member facing said drive adapter housing and said drive adapter housing has a projection thereon capable of snap fitting extension into said detent such that by merely pushing on said drive adapter toward said socket member the projection will extend into the detent and releasably lock the drive adapter to the housing member and merely by pulling on the drive adapter away from the housing member the projection will separate from the detent allowing separation of the adapter from the drive socket without need of any tool therefore.

8. An air tool wrench which comprises;

a) a circularly shaped socket member having a socket housing surrounding the socket member;

b) a polygonal central opening in the socket member for engaging a nut or bolt and having a central axis coincident with the axis of the socket housing;

c) a bearing member extending circumferentially around and rotatably supporting said socket member within said socket housing for rotation on the central axis of said central opening;

d) said socket member having a plurality of gear teeth thereon extending circularly around the central axis of the socket member which is an axis of rotation of the socket member;

e) at least one drive adapter connected to said gear teeth on said socket member for drivingly rotating said socket member, said drive adapter further comprising;

1) an elongate drive shaft mounted on an axis substantially perpendicular to the axis of rotation of said socket member;

2) an input gear mounted on a first end of said drive shaft and in meshing engagement with the gear teeth on said socket member for rotation thereof;

3) an elongate drive adapter housing for said drive shaft;

4) a central axial bore in said drive adapter housing;

5) bearing members in the wall of said housing adjacent to and surrounding said bore for engaging and rotatably supporting said shaft for axial rotation in said bore;

6) said socket housing having an opening on one side thereof to receive said first end of said drive shaft and said input gear thereon, a first end of said elongate drive adapter housing which corresponds to the first end of said drive shaft extending within said socket housing to close said opening;

7) a power drive for said drive shaft;

8) detachable locking means between the first end of said elongate drive adapter housing and said socket housing, said detachable locking means comprising a snap lock on the adjacent walls of said drive adapter housing and said socket housing, said snap lock being operable merely by pushing the drive adapter into the opening of said socket housing to detachably lock same and merely by pulling the drive adapter away from the socket housing to detach the same without need of any mechanical tools therefore; and 9) detachable connecting means between said drive adapter and drive adapter housing at a second end thereof corresponding to a second end of the drive shaft and adjacent said second end of said drive shaft for optionally attaching and detaching said drive adapter from said power drive, said detachable connecting means comprising a connector member mounted on said second end of said drive shaft within said drive adapter housing and a mating connector member on said power drive.

9. The wrench of claim 8, said power drive being a compressed air motor, said connector member on said drive shaft being a female coupling member and said mating connector member being a driver member received within and frictionally engaging said female coupling member and imparting the power drive to said shaft and input gear and to said socket member.

10. The air tool wrench of claim 8, wherein a plurality of individual drive adapters are provided for use in said wrench, and each of said drive adapters having a length which is different from the other drive adapters to enable the wrench to be extended into confined areas of differing depths.

11. In a power driven socket wrench having:

a) a circular socket member having a socket housing surrounding the socket member;

b) a polygonal central opening in the socket member for engaging a nut or bolt and having a central axis coincident with the axis of the socket housing;

c) a bearing member extending circumferentially around and rotatably supporting said socket member within said socket housing for rotation on the central axis of said central opening;

d) said socket member having a plurality of gear teeth thereon extending circularly around the central axis of the socket member which is an axis of rotation of the socket member;

e) a power drive for said socket member;

f) the improvement which comprises a plurality of individual drive adapters for use in said power driven socket wrench and each of said drive adapters having a length which is different from the other drive adapters to enable the wrench to be extended into confined areas of differing depths;

g) each drive adapter connecting said power drive and said socket member, each said drive adapter further comprising:

1) an elongate drive shaft mounted on an axis substantially perpendicular to the axis of rotation of said socket member;

2) an input gear mounted on a first end of said drive shaft and in meshing engagement with the gear teeth on said socket member for rotation thereof such that the input gear and the gear teeth form a bevel teeth arrangement;

3) an elongate cylindrically shaped drive adapter housing for said drive shaft;

4) a central axial bore in said drive adapter housing;

5) bearing members in the wall of said housing adjacent to and surrounding said bore for engaging and rotatably supporting said shaft for axial rotation in said bore;

6) said socket housing having an opening on one side thereof to receive said first end of said drive shaft and said input gear thereon, a first end of said elongate drive adapter housing which corresponds to the first end of said drive shaft extending within said socket housing to close said opening;

7) a power drive for said drive shaft;

8) detachable locking means between the first end of said elongate drive adapter housing and said socket housing, said detachable locking means comprising a snap lock on the adjacent walls of said drive adapter housing and said socket housing, said snap lock being operable merely by pushing the drive adapter into the opening of said socket housing to detachably lock same and merely by pulling the drive adapter away from the socket housing to detach without need of any mechanical tools therefore;

9) detachable connecting means between said drive adapter and drive adapter housing at a second end thereof corresponding to a second end of the drive shaft and adjacent said second end of said drive shaft for optionally attaching and detaching said drive adapter from said power drive, said detachable connecting means comprising a connector member mounted on said second end of said drive shaft within said drive adapter housing and a mating connector member on said power drive such that differing sized drive adapters may be attached to said power drive increasing the versatility of the socket wrench to be extended into confined regions at a desired depth.

* * * * *